US010293223B2

(12) United States Patent
Kii

(10) Patent No.: US 10,293,223 B2
(45) Date of Patent: May 21, 2019

(54) GOLF CLUB HEAD

(71) Applicant: SUMITOMO RUBBER INDUSTRIES, LTD., Kobe-shi, Hyogo (JP)

(72) Inventor: Kenji Kii, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/952,812

(22) Filed: Apr. 13, 2018

(65) Prior Publication Data

US 2018/0296884 A1 Oct. 18, 2018

(30) Foreign Application Priority Data

Apr. 14, 2017 (JP) ..... 2017-080416

(51) Int. Cl.
*A63B 53/04* (2015.01)

(52) U.S. Cl.
CPC .... *A63B 53/047* (2013.01); *A63B 2053/0408* (2013.01); *A63B 2053/0445* (2013.01)

(58) Field of Classification Search
USPC ..... 473/324–350
See application file for complete search history.

(56) References Cited

U.S. PATENT DOCUMENTS 5,024,437 A * 6/1991 Anderson ..... A63B 53/04 473/342
5,931,746 A * 8/1999 Soong ..... A63B 53/04 473/329
6,506,129 B2 1/2003 Chen
6,663,501 B2 * 12/2003 Chen ..... A63B 53/0466 473/324
6,971,961 B2 * 12/2005 Chen ..... A63B 53/04 473/342
6,994,636 B2 * 2/2006 Hocknell ..... A63B 53/0466 473/342
7,029,403 B2 * 4/2006 Rice ..... A63B 53/0466 473/329
7,121,958 B2 * 10/2006 Cheng ..... A63B 53/047 473/345

(Continued)

FOREIGN PATENT DOCUMENTS

GB 2445058 A * 6/2008 ..... A63B 53/0466
JP 10057534 A * 3/1998

(Continued)

*Primary Examiner* — Alvin A Hunter
(74) *Attorney, Agent, or Firm* — Birch, Stewart, Kolasch & Birch LLP

(57) ABSTRACT

A head 2 includes a face member fc1 formed by casting and a body member bd1 having an opening 20 on a hitting surface 4 side. The opening of the body member bd1 is covered by the face member fc1. The face member fc1 includes a flat plate portion PT forming the hitting surface 4 and a flange FL extending backward from a peripheral edge of the flat plate portion PT. The flange FL includes a first flange FL1 located in a top-side region, and a second flange FL2 located in a sole-side region. The flange FL is not provided in a toe-side region and a heel-side region. The flange FL is joined to the body member bd1.

12 Claims, 15 Drawing Sheets

(56) References Cited

U.S. PATENT DOCUMENTS

| | | | | |
|---|---|---|---|---|
| 7,207,898 | B2 * | 4/2007 | Rice | A63B 60/00 473/329 |
| 7,367,899 | B2 * | 5/2008 | Rice | A63B 53/0466 473/329 |
| 7,371,188 | B2 * | 5/2008 | Chen | A63B 53/04 473/329 |
| 7,431,665 | B2 * | 10/2008 | Sugimoto | A63B 53/047 473/342 |
| 7,575,525 | B2 * | 8/2009 | Matsunaga | A63B 53/0466 473/342 |
| 7,704,162 | B2 * | 4/2010 | Rice | A63B 60/00 473/329 |
| 8,025,590 | B2 * | 9/2011 | Rice | A63B 60/00 473/329 |
| 8,376,879 | B2 * | 2/2013 | Wada | A63B 53/0466 473/342 |
| 2004/0138001 | A1 * | 7/2004 | Sano | A63B 53/0466 473/324 |
| 2004/0266548 | A1 * | 12/2004 | Cheng | A63B 53/047 473/342 |
| 2006/0030424 | A1 * | 2/2006 | Su | A63B 53/0466 473/342 |
| 2006/0252576 | A1 * | 11/2006 | Lo | A63B 53/0466 473/342 |

FOREIGN PATENT DOCUMENTS

| | | | | | |
|---|---|---|---|---|---|
| JP | 10201885 | A | * | 8/1998 | |
| JP | 2002186692 | A | * | 7/2002 | |
| JP | 2004215724 | A | * | 8/2004 | |
| JP | 2008154624 | A | * | 7/2008 | A63B 53/0466 |
| JP | 2011101711 | A | * | 5/2011 | A63B 53/0466 |
| JP | 4958625 | B2 | | 6/2012 | |
| JP | 5416737 | B2 | | 2/2014 | |

* cited by examiner

GOLF CLUB HEAD

The present application claims priority on Patent Application No. 2017-80416 filed in JAPAN on Apr. 14, 2017, the entire contents of which are hereby incorporated by reference.

BACKGROUND OF THE INVENTION

Field of the Invention

The present invention relates to a golf club head.

Description of the Related Art

As to a golf club head including a body member and a face member attached to the body member, the following patens are disclosed. Each of Japanese Patent No. 5416737 and Japanese Patent No. 4958625 discloses a head including a face member having a bent portion which is bent backward at a sole side end of the face member. U.S. Pat. No. 7,371,188 discloses a hitting plate part having an annular wall. U.S. Pat. No. 6,506,129 discloses a front member having an extension portion.

SUMMARY OF THE INVENTION

The inventor of the present application has found that there is room to improve a head including a body member and a face member attached to the body member.

The present disclosure provides a golf club head excellent in rebound performance and having a high productivity.

In one aspect, a golf club head may include a face member formed by casting, and a body member having an opening on a hitting surface side. The opening of the body member may be covered by the face member. The face member may include a flat plate portion forming the hitting surface, and a flange extending backward from a peripheral edge of the flat plate portion. The flange may have a first flange located in a top-side region, and a second flange located in a sole-side region. The flange may not be provided in a toe-side region nor a heel-side region. The flange may be joined to the body member.

In another aspect, the second flange may have a height H2 greater than a height H1 of the first flange.

In another aspect, the second flange may have a thickness T2 greater than a thickness T1 of the first flange.

In another aspect, the thickness T2 of the second flange may be smaller than the thickness T1 of the first flange.

BRIEF DESCRIPTION OF THE DRAWINGS

FIG. 11 is a drawing viewed from an obliquely front side;

FIG. 12 is a drawing viewed from an obliquely back side;

DESCRIPTION OF THE PREFERRED EMBODIMENTS

Hereinafter, preferred embodiments will be described in detail with appropriate references to the accompanying drawings.

In the present application, the following terms are defined.

[Base State]

The base state is a state where a head is placed at a specified lie angle and real loft angle on a level surface HP. In the base state, a center axis line Z (shaft axis line Z) of a shaft hole of the head is disposed in a perpendicular plane VP (see FIG. 15). The perpendicular plane VP is a plane perpendicular to the level surface HP. In the base state, a face surface (hitting surface) is inclined at a real loft angle with respect to the perpendicular plane VP. The specified lie angle and real loft angle are described in, for example, a product catalog.

[Toe-Heel Direction]

Figure 15:
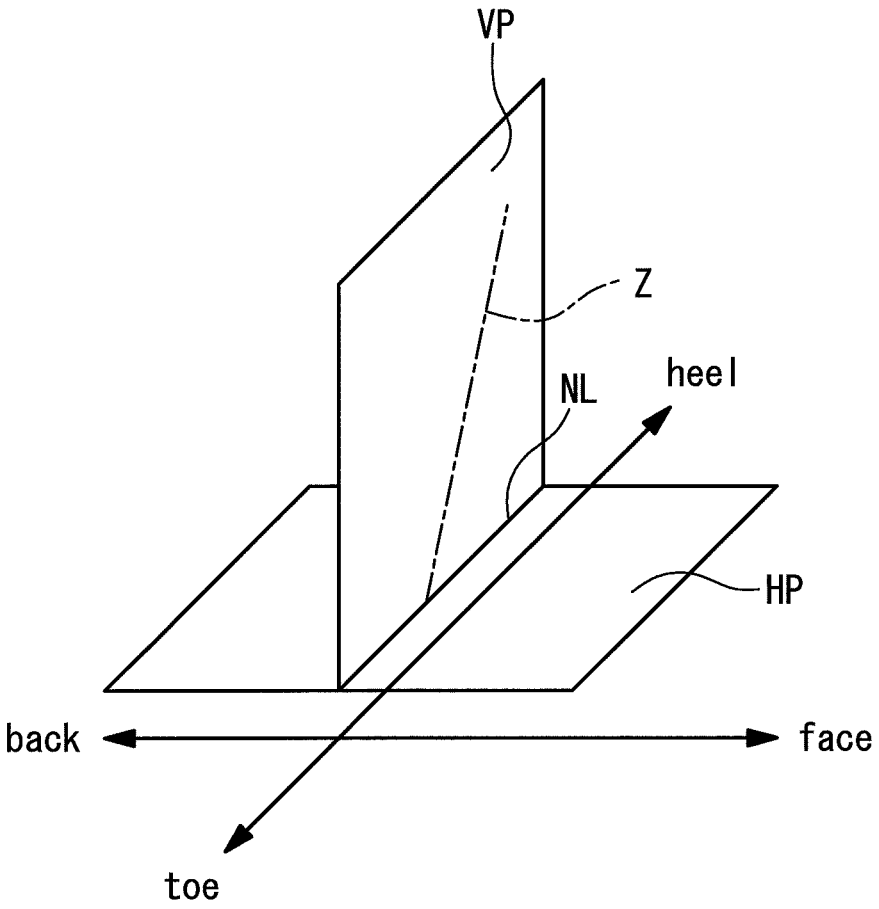
FIG. 15 is a view for illustrating a base state.

In the head of the base state, a direction of an intersection line NL between the perpendicular plane VP and the level surface HP is the toe-heel direction (see FIG. 15). A toe side and a heel side used in the present application should be based on the toe-heel direction.

[Face-Back Direction]

A direction perpendicular to the toe-heel direction and parallel to the level surface HP is the face-back direction (see FIG. 15). A face side and a back side used in the present application should be based on the face-back direction.

[Up-Down Direction]

A direction perpendicular to the toe-heel direction and parallel to the hitting surface is the up-down direction. An upper side and a lower side used in the present application should be based on the up-down direction.

[Face Perpendicular Direction]

A direction perpendicular to the hitting surface (a face) is defined as the face perpendicular direction. In other words, a direction of a normal line of the hitting surface is defined as the face perpendicular direction.

[Face Center Fc]

Figure 2:
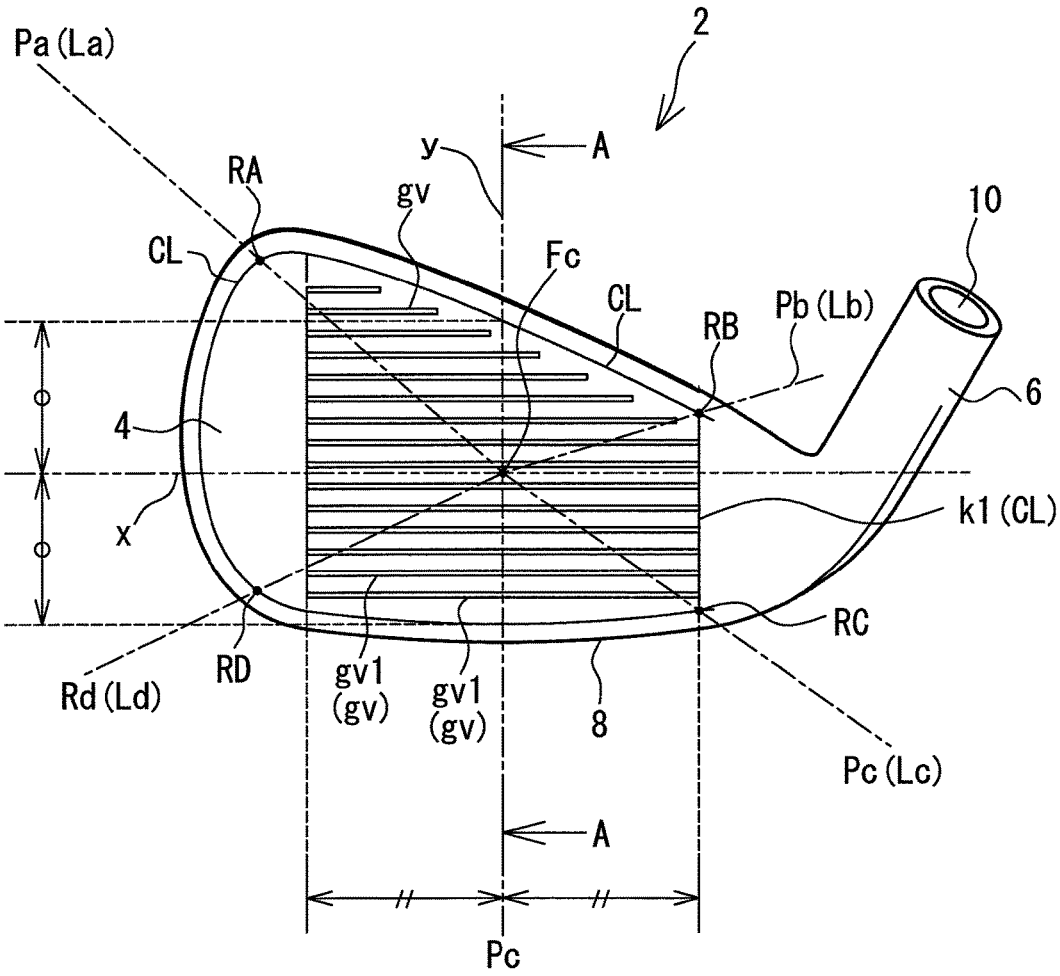
FIG. 2 is a front view of the head in FIG. 1.

A middle position of a longest score line gv1 in the toe-heel direction is a middle position Pc of score lines in the toe-heel direction (see FIG. 2). On the middle position Pc, a center point of the face surface in the up-down direction is determined. The center point in the up-down direction is the face center Fc (see FIG. 2).

Figure 1:
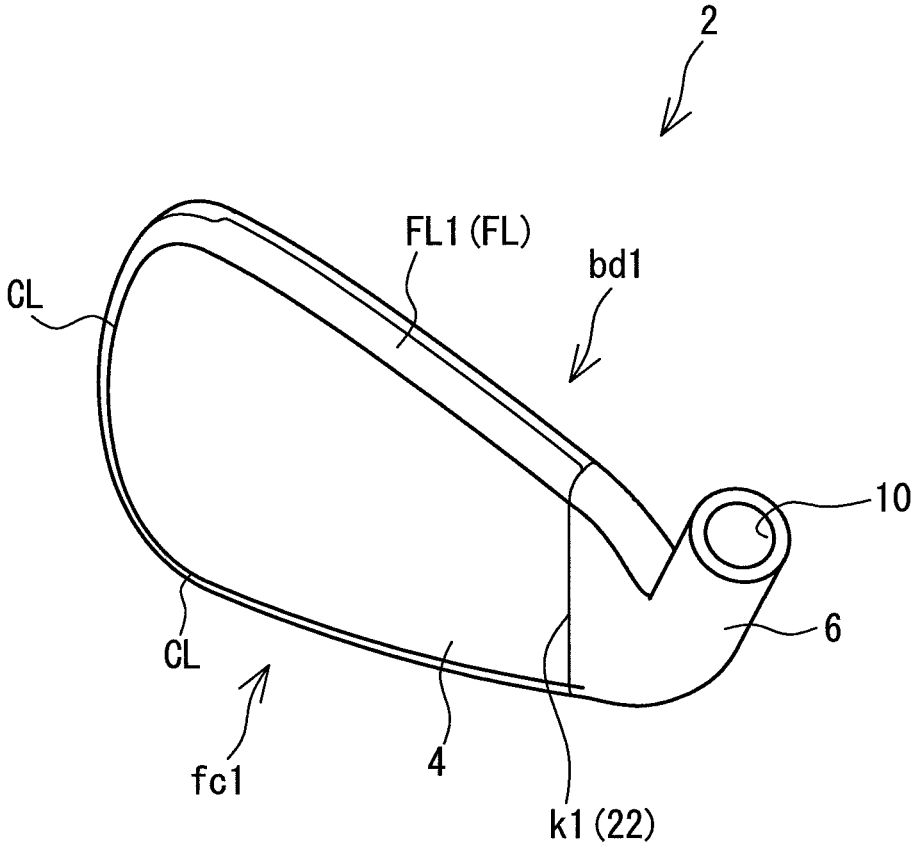
FIG. 1 is a perspective view of a golf club head according to a first embodiment.
Figure 3:
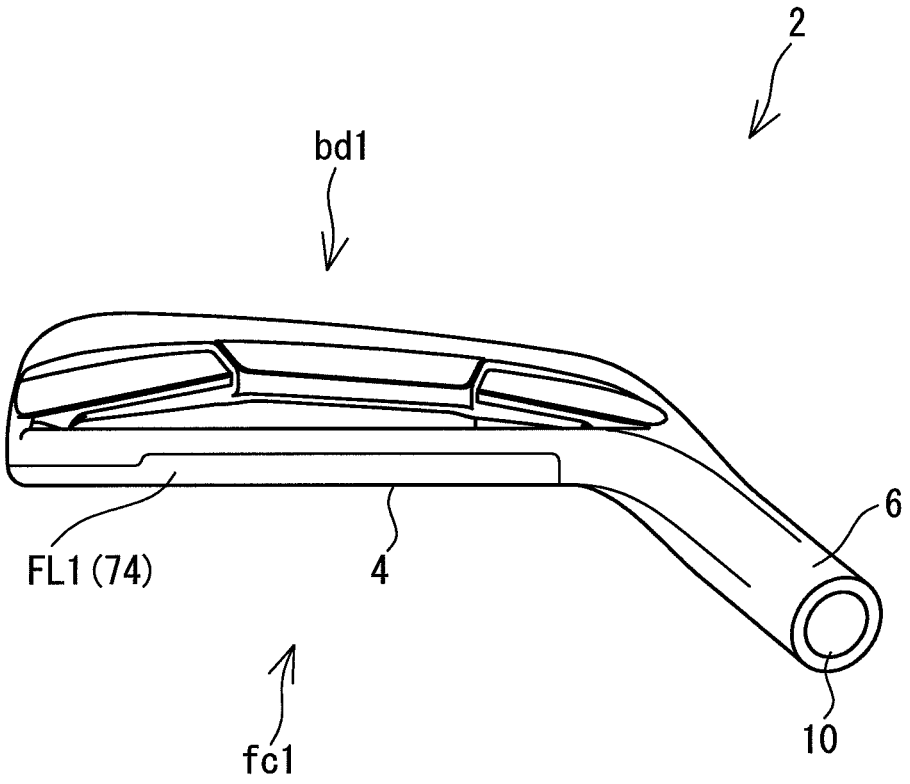
FIG. 3 is a plan view of the head in FIG. 1 as viewed from a top side.
Figure 4:
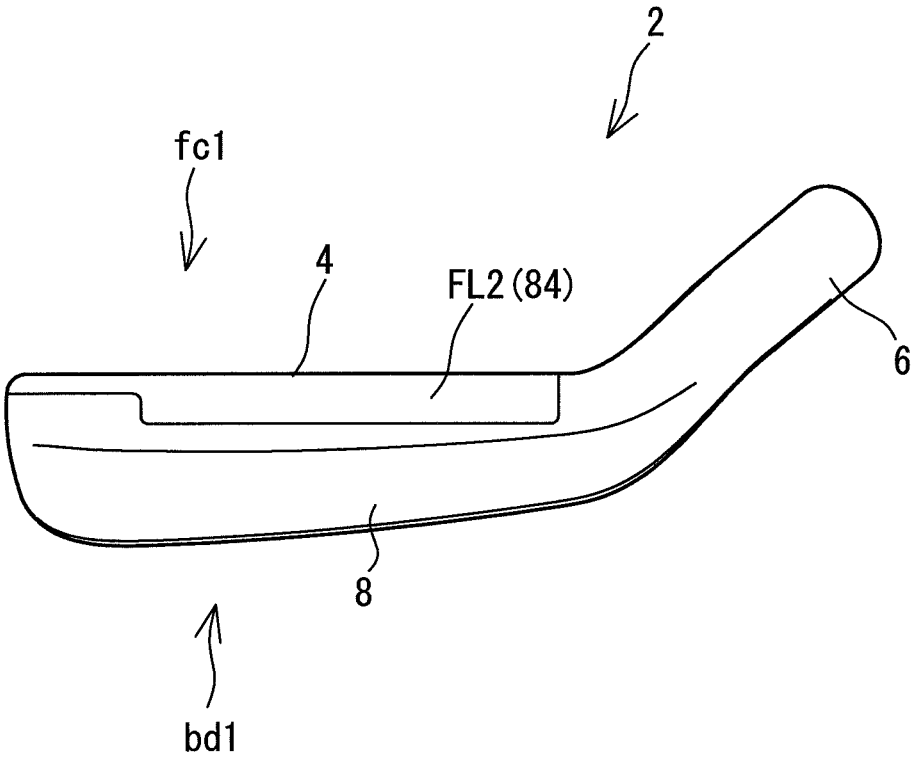
FIG. 4 is a bottom view of the head in FIG. 1 as viewed from a sole side.
Figure 5:
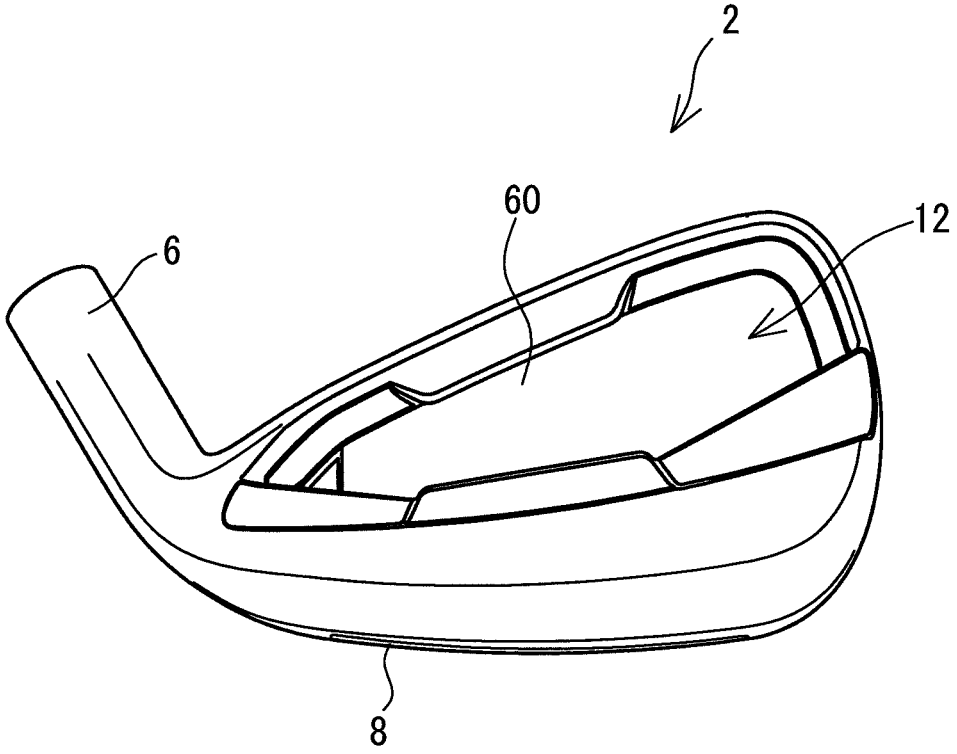
FIG. 5 is a back view of the head in FIG. 1.

FIG. 1 is a perspective view of a golf club head 2 according to a first embodiment. FIG. 2 is a front view of the head 2. FIG. 2 is a diagram viewed from the front of a hitting surface. FIG. 3 is a plan view of the head 2 as viewed from a top side. FIG. 4 is a bottom view of the head 2 as viewed from a sole side. FIG. 5 is a back view of the head 2.

The head 2 includes a hitting surface 4, a hosel 6, and a sole 8. The hosel 6 has a hosel hole 10. The hitting surface 4 is also referred to as a face. As shown in FIG. 2, a plurality of score lines gv are provided on the front face of the hitting surface 4. The score lines gv include the longest score line gv1. The longest score line gv1 is the longest score line in the score lines gv. Note that the score lines are not depicted in the drawings other than FIG. 2. The head 2 is an iron type golf club head.

If the score lines gv are disregarded, the face 4 is a plane. The hitting surface 4 has a contour line CL. The contour line CL is a boundary between the plane and a non-flat surface.

As shown in FIG. 5, in the head 2, a back cavity (recess part) 12 is provided on the opposite side of the hitting surface 4. The head 2 is a cavity back iron.

Figure 6:
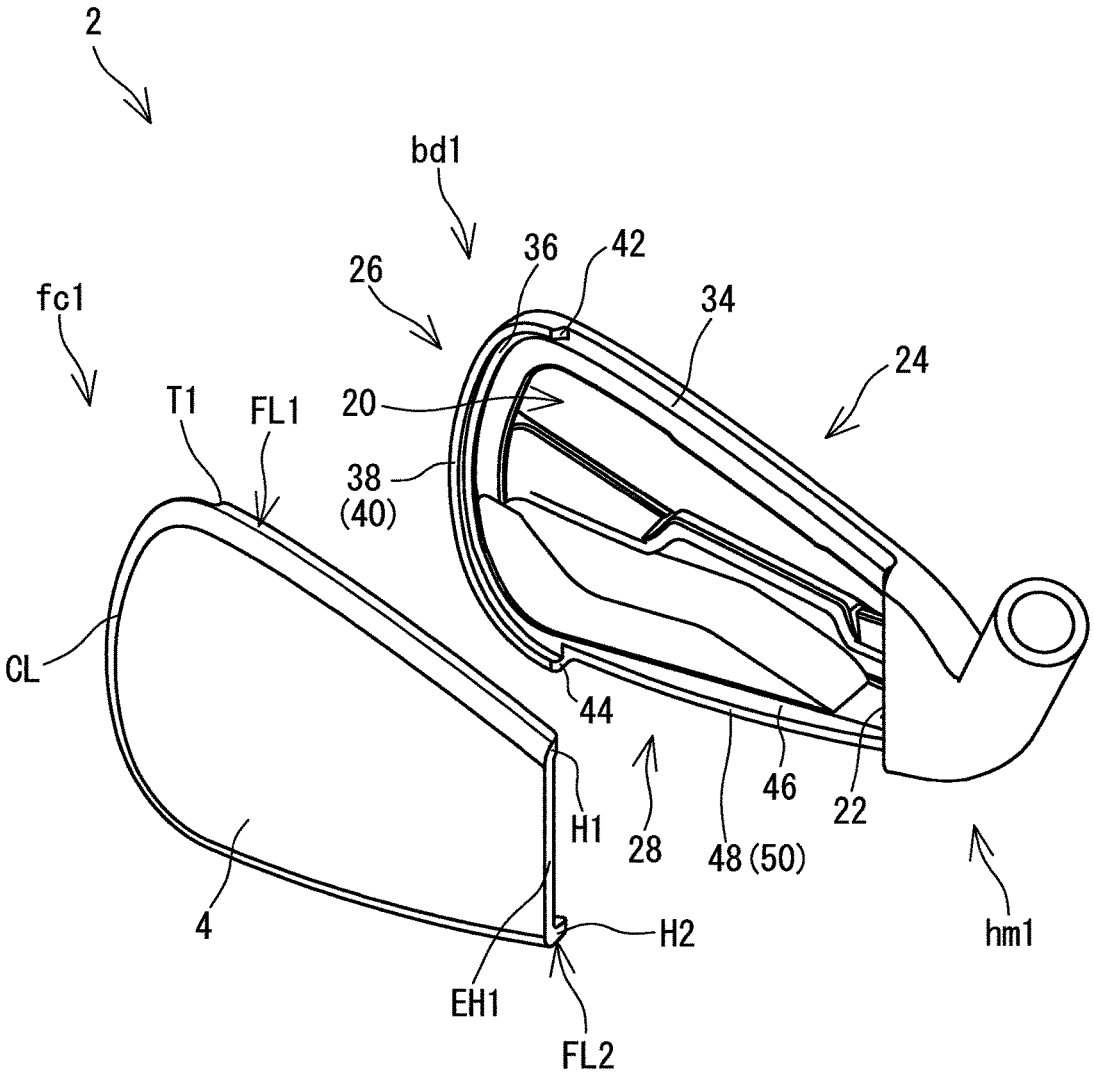
FIG. 6 is an exploded perspective view of the head in FIG. 1.
Figure 7:
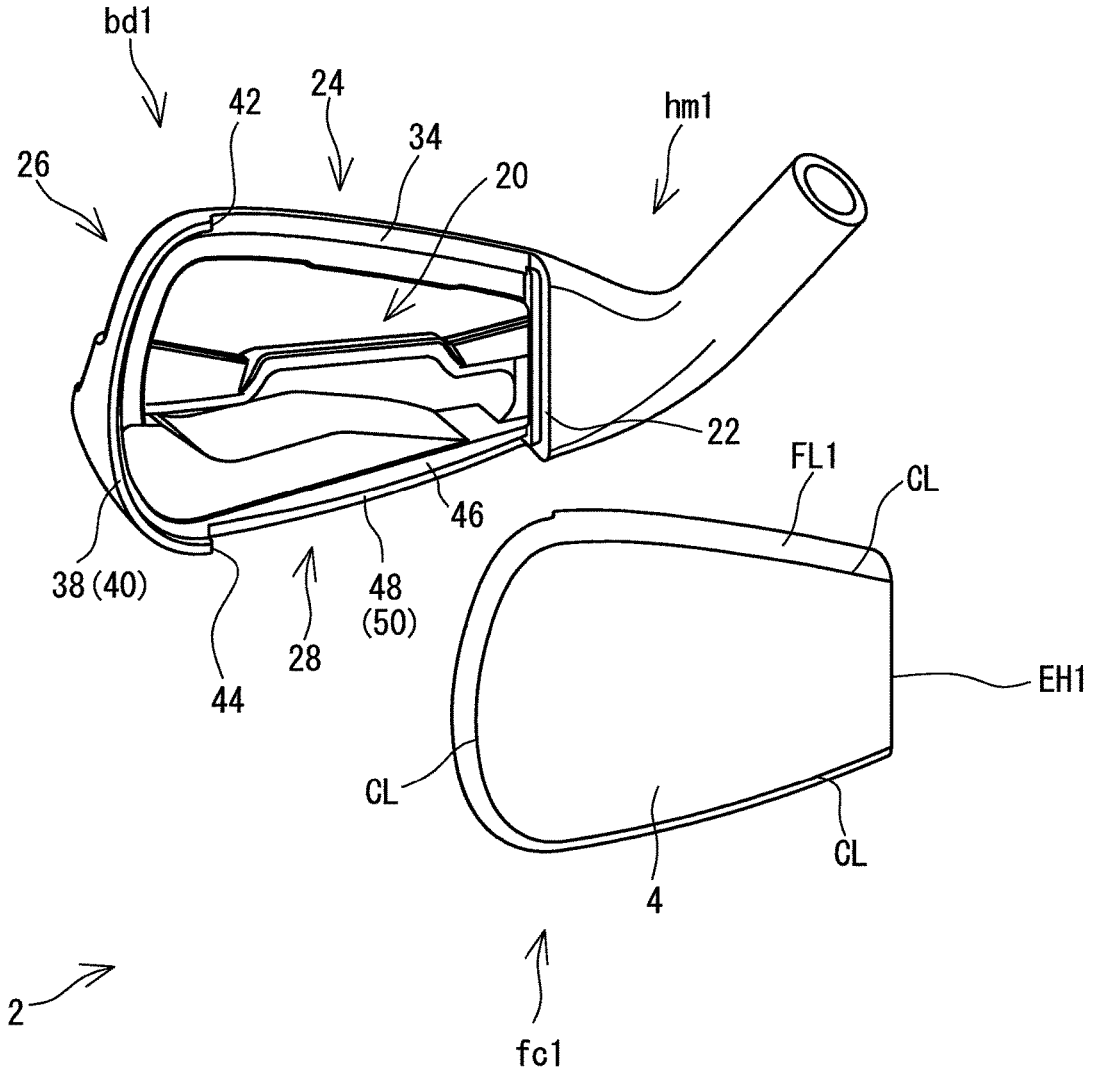
FIG. 7 is an exploded perspective view of the head in FIG. 1 as viewed from a point different from the viewpoint of FIG. 6.
Figure 8:
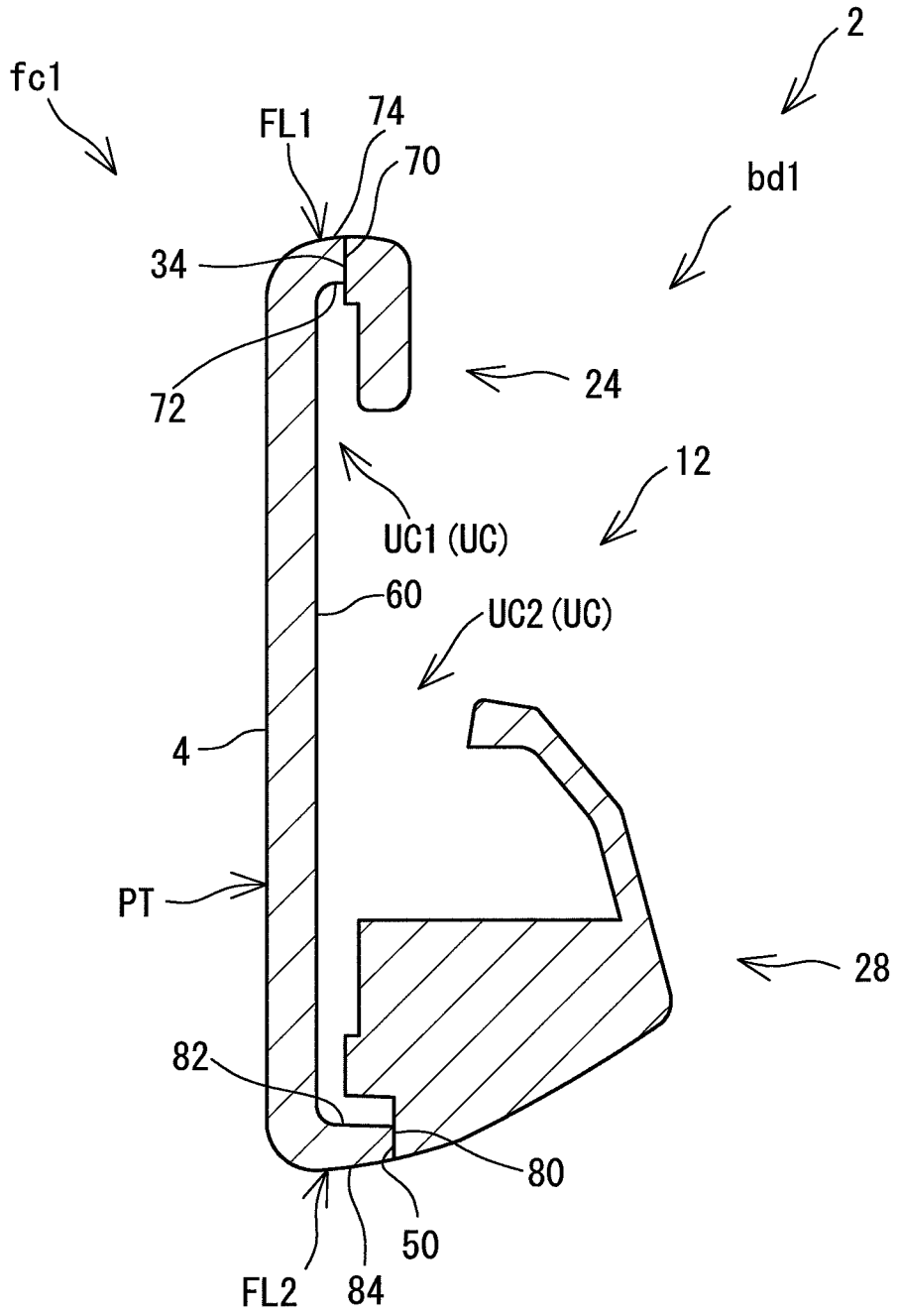
FIG. 8 is a sectional view taken along line A-A in FIG. 2.

FIG. 6 is an exploded perspective view of the head 2. FIG. 7 is an exploded perspective view of the head 2 as viewed from a different angle. FIG. 8 is a sectional view taken along line A-A in FIG. 2.

The head 2 includes a body member bd1 and a face member fc1. The face member fc1 is fixed to the body member bd1. The face member fc1 is welded to the body member bd1. The body member bd1 is made of a metal. In the present embodiment, the body member bd1 is made of stainless steel. The face member fc1 is made of a metal. In the present embodiment, the face member fc1 is made of stainless steel. The materials of the body member bd1 and the face member fc1 are not limited.

The specific gravity of the face member fc1 may be smaller than the specific gravity of the body member bd1. The face member fc1 having a smaller specific gravity contributes to the distribution of the weight of the head 2 to the circumference. In light of welding strength, the material of the face member fc1 is preferably the same as that of the body member bd1.

The body member bd1 is opened toward the hitting surface side. This opening is covered by the face member fc1. The body member bd1 is also opened backward. The body member bd1 has a through hole 20 penetrating through the body member bd1 from the face side to the back side (see FIG. 6 and FIG. 7). The though hole 20 is covered by the face member fc1.

The body member bd1 has a heel boundary surface 22, a top portion 24, a toe portion 26, and a sole portion 28 (see FIG. 6 and FIG. 7). The heel boundary surface 22 is extended in the up-down direction. The heel boundary surface 22 is a plane. The heel boundary surface 22 is a plane parallel to the face-back direction. The heel boundary surface 22 constitutes a boundary k1 between the face member fc1 and the body member bd1 (see FIG. 1). The boundary k1 is exposed to the outside, and is also referred to as an outside boundary.

In the body member bd1, a portion located on the heel side with respect to the heel boundary surface 22 is also referred to as a heel main portion hm1. The heel main portion hm1 includes the hosel 6. The face member fc1 is not present in front of the heel main portion hm1. The face member fc1 covers the front of a part of the body member bd1 which is located on the toe side with respect to the heel boundary surface 22.

The top portion 24 is extended toward the toe side from the upper side of the heel main portion hm1. The top portion 24 connects the heel main portion hm1 and the toe portion 26. The toe portion 26 connects the top portion 24 and the sole portion 28. The sole portion 28 connects the toe portion 26 and the heel main portion hm1. The heel main portion hm1, the top portion 24, the toe portion 26 and the sole portion 28 constitute an annular part as a whole. The inside of the annular part is the through hole 20.

The top portion 24 has a top receiving surface 34. The top receiving surface 34 constitutes a front face of the top portion 24. The top receiving surface 34 is a plane. The top receiving surface 34 is a plane parallel to the hitting surface 4.

The toe portion 26 has a toe base part 36 and a toe wall part 38 projected forward from the toe base part 36. The toe wall part 38 is provided along an outer edge of the toe base part 36. The toe wall part 38 has a toe receiving surface 40. The toe receiving surface 40 constitutes a front face of the toe wall part 38. The toe receiving surface 40 is a plane. The toe receiving surface 40 is a plane parallel to the hitting surface 4.

Figure 12:
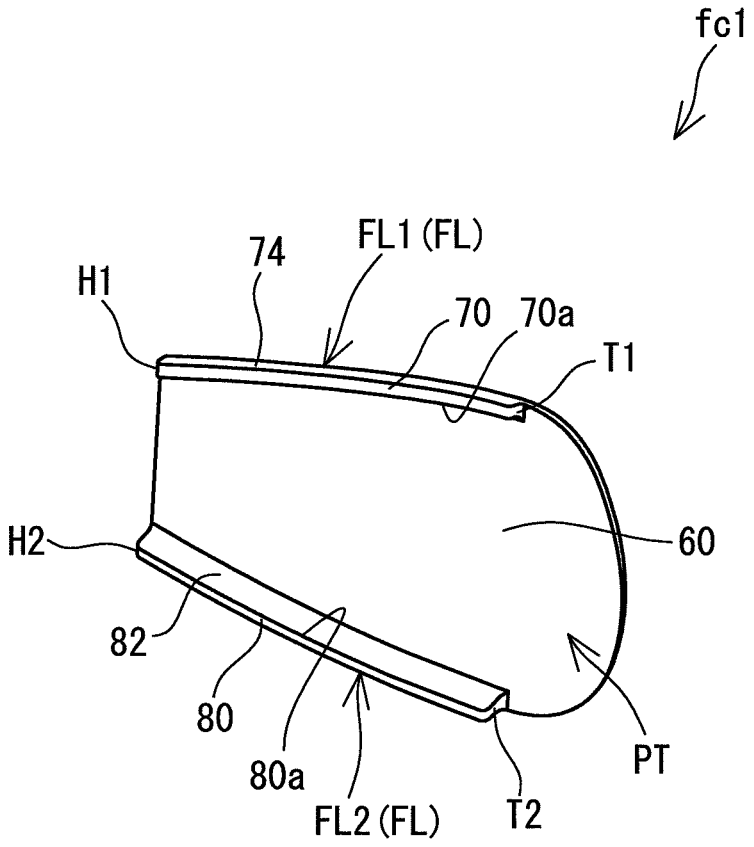
FIG. 12 is a perspective view of the face member in FIG. 9.

The toe receiving surface 40 that is the front face of the toe wall part 38 is brought into contact with a back surface 60 of the face member fc1. As shown in FIG. 12 described later, although a flange FL is not provided in a toe-side region of the face member fc1, the toe receiving surface 40 supports a peripheral edge part in the toe-side region of the face member fc1. The toe wall part 38 projected forward enables a flat plate portion PT to be floating from the body member bd1 even in the toe-side region in which the flange FL is not present. For this reason, the flat plate portion PT is apt to be deformed at impact also in the toe-side region. The toe wall part 38 contributes to improvement in rebound performance.

The toe wall part 38 as a whole is curved so as to project toward the outside of the head 2. The toe wall part 38 is located at least in the toe-side region. In the present embodiment, the toe wall part 38 is present also in a top-side region. In the present embodiment, the toe wall part 38 is present also in a sole-side region. The toe wall part 38 is extended from the top-side region, through the toe-side region, to the sole-side region.

As well shown in FIG. 6, the toe wall part 38 has a top-side end face 42. The top-side end face 42 is an end face on one side of the toe wall part 38. The top-side end face 42 is located in the top-side region.

As well shown in FIG. 6, the toe wall part 38 has a sole-side end face 44. The sole-side end face 44 is an end face on the other side of the toe wall part 38. The sole-side end face 44 is located in the sole-side region. The toe wall part 38 is curvedly extended from the top-side end face 42 to the sole-side end face 44.

The sole portion 28 has a sole base part 46 and a sole stepped part 48 which is recessed backward from the sole base part 46. The sole stepped part 48 is provided along an outer edge of the sole base part 46. The sole stepped part 48 has a sole receiving surface 50. The sole receiving surface 50 constitutes the front face (bottom face) of the sole stepped part 48. The sole receiving surface 50 is a plane. The sole receiving surface 50 is a plane parallel to the hitting surface 4.

Figure 9:
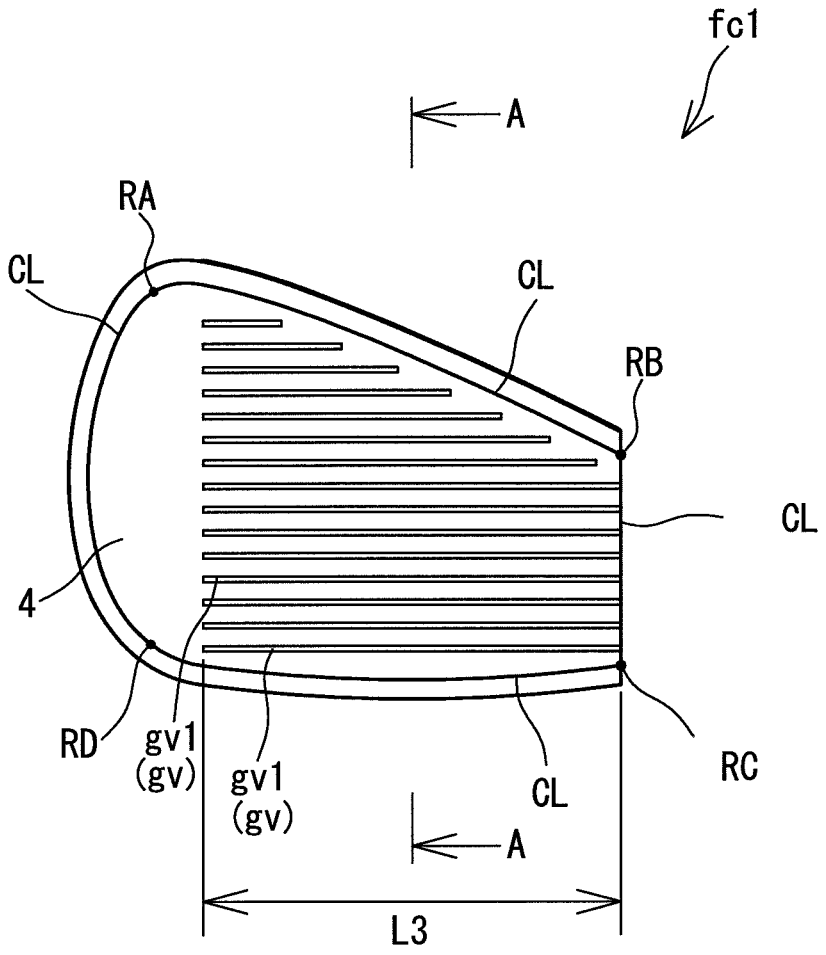
FIG. 9 is a front view of a face member used for the head in FIG. 1.
Figure 10:
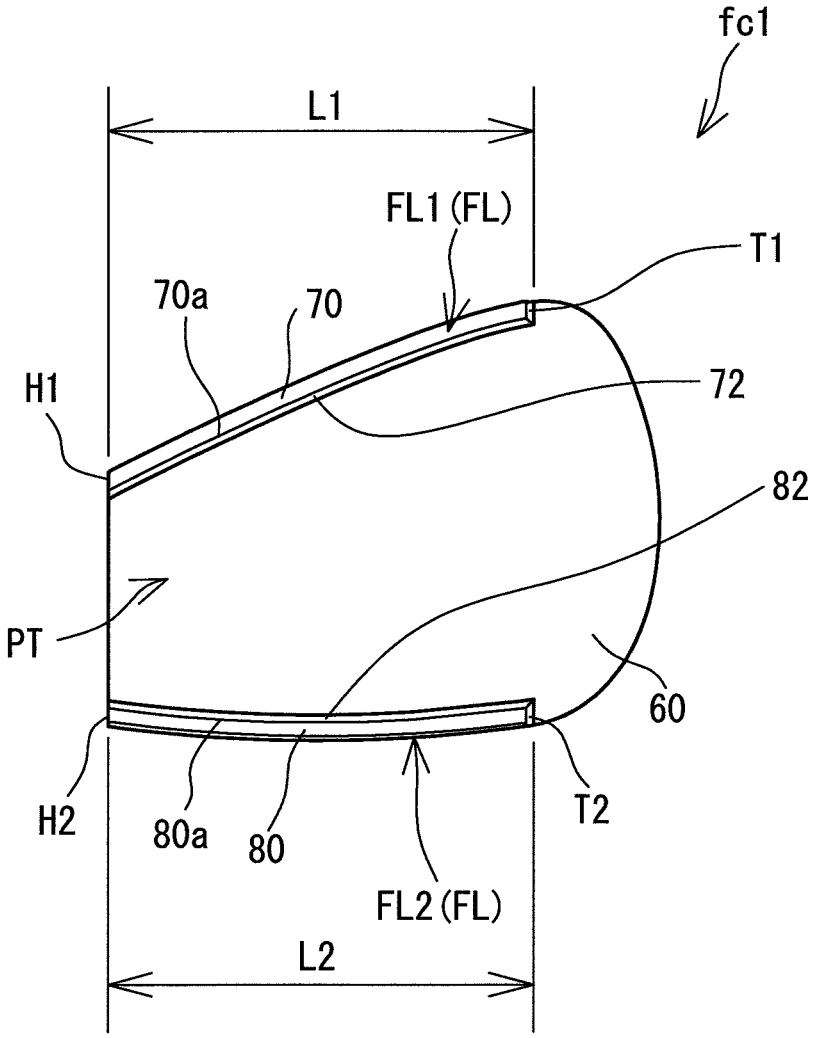
FIG. 10 is a back view of the face member in FIG. 9.
Figure 11:
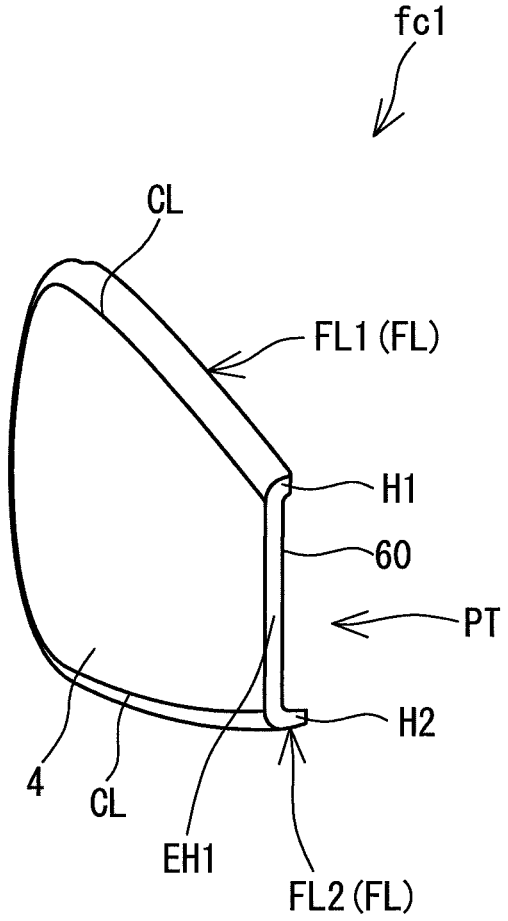
FIG. 11 is a perspective view of the face member in FIG. 9.

FIG. 9 is a front view of the face member fc1. FIG. 10 is a back view of the face member fc1. FIG. 11 is a perspective view of the face member fc1 as viewed from an obliquely front side. FIG. 12 is a perspective view of the face member fc1 as viewed from an obliquely back side. Furthermore, FIG. 6 and FIG. 7 described above show the face member fc1 as viewed from different angles.

The face member fc1 is formed by casting. Examples of the method of casting includes a sand casting process, gypsum casting process, precision casting process, mold casting process, a centrifugal casting process, etc. The method of casting is not limited. In light of forming accuracy, lost-wax precision casting process is preferably used.

As shown in FIG. 9, the above-mentioned plurality of score lines gv are provided on the front face of the face member fc1. The front face of the face member fc1 is the hitting surface 4.

As well shown in FIG. 12, the face member fc1 has the flat plate portion PT and the flange FL. The front face of the flat plate portion PT is the hitting surface 4. The flat plate portion PT forms the hitting surface 4.

The flat plate portion PT has the back surface 60. The back surface 60 is a single plane. If the score lines gv are disregarded, the flat plate portion PT has a constant thickness. The back surface 60 is parallel to the hitting surface 4. The back surface of the face member fc1 is constituted by only the flange FL and the back surface 60. The flange FL is extended backward from the peripheral edge of the flat plate portion PT. The flange FL is joined to the body member bd1.

[Top-Side Region, Sole-Side Region, Toe-Side Region, Heel-Side Region]

In the present application, terms of the top-side region, the sole-side region, the toe-side region, and the heel-side region are used.

In the front view of FIG. 2, a straight line x and a straight line y are defined. The straight line x is a straight line passing through the face center Fc and being parallel to the toe-heel direction. The straight line y is a straight line passing through the face center Fc and being parallel to the up-down direction.

As shown in FIG. 2, the contour line CL of the hitting surface 4 is divided into four sections by the straight line x and the straight line y. A curvature-radius minimum point is determined in each of the four sections. In FIG. 2 and FIG. 9, the curvature-radius minimum point in a toe-upper section is shown by symbol RA. The curvature-radius minimum point in a heel-upper section is shown by symbol RB. The curvature-radius minimum point in a heel-lower section is shown by symbol RC. The curvature-radius minimum point in a toe-lower section is shown by symbol RD. Note that, in each of the sections, when there is a pointed vertex, this point is considered as the curvature-radius minimum point. In the present embodiment, the point RB and the point RC are vertexes of angles, and thus these points RB and RC are considered as the curvature-radius minimum points.

As shown in FIG. 2, a straight line which connects the point RA and the face center Fc is a straight line La. A straight line which connects the point RB and the face center Fc is a straight line Lb. A straight line which connects the point RC and the face center Fc is a straight line Lc. A straight line which connects the point RD and the face center Fc is a straight line Ld.

The face member fc1 can be divided into four sections by expanding the straight lines La to Ld into three dimensions. A plane Pa which includes the straight line La and is perpendicular to the hitting surface 4; a plane Pb which includes the straight line Lb and is perpendicular to the hitting surface 4; a plane Pc which includes the straight line Lc and is perpendicular to the hitting surface 4; and a plane Pd which includes the straight line Ld and is perpendicular to the hitting surface 4 are defined (see FIG. 2). The face member fc1 is divided into the toe-side region, the heel-side region, the top-side region, and the sole-side region by the four planes Pa, Pb, Pc, and Pd.

Among these four regions, the flange FL is provided in the top-side region and the sole-side region. The flange FL located in the top-side region is also referred to as a first flange. The flange FL located in the sole-side region is also referred to as a second flange. The flange FL includes the first flange FL1 located in the top-side region, and the second flange FL2 located in the sole-side region. The flange FL is constituted of only the first flange FL1 and the second flange FL2. Any flange FL other than the first flange FL1 and the second flange FL2 does not exist.

The flange FL is not provided in the toe-side region. The flange FL is not provided in the heel-side region. In portions in which the flange FL is not provided, the back surface 60 reaches the outer edge of the face member fc1 (see FIG. 12).

Figure 13:
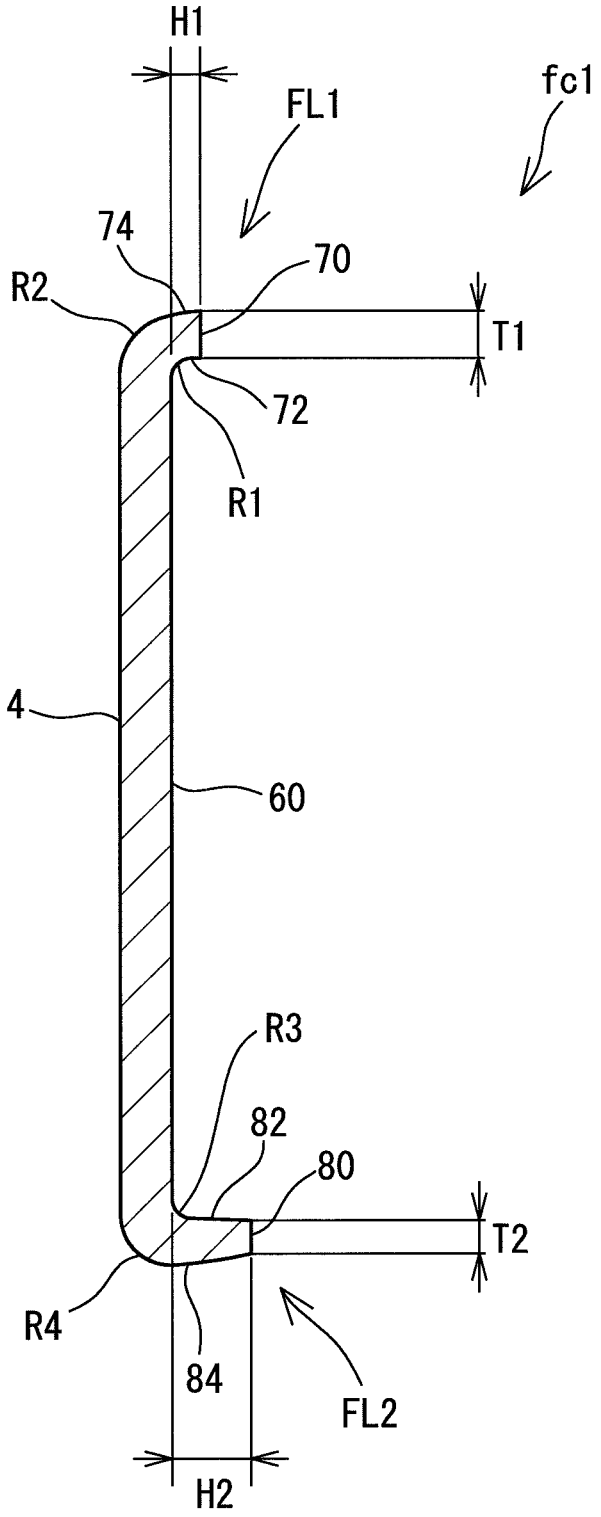
FIG. 13 is a sectional view taken along line A-A in FIG. 9.

As well shown in FIG. 13, the first flange FL1 has a backend surface 70, an inner surface 72, and an outer surface 74. The backend surface 70 is parallel to the hitting surface 4. The backend surface 70 is parallel to the back surface 60. The inner surface 72 is continuous with the back surface 60. A roundness R1 is provided on the boundary between the inner surface 72 and the back surface 60. The outer surface 74 is continuous with the hitting surface 4. A roundness R2 is provided on the boundary between the outer surface 74 and the hitting surface 4. The outer surface 74 constitutes a part of a top surface of the head 2.

The roundness R1 improves molten metal flow in casting of the face member fc1, and can reduce defective rate in the casting. The roundness R2 improves molten metal flow in the casting of the face member fc1, and can reduce defective rate in the casting.

As well shown in FIG. 13, the second flange FL2 has a backend surface 80, an inner surface 82, and an outer surface 84. The backend surface 80 is parallel to the hitting surface 4. The backend surface 80 is parallel to the back surface 60. The inner surface 82 is continuous with the back surface 60. A roundness R3 is provided on the boundary between the inner surface 82 and the back surface 60. The outer surface 84 is continuous with the hitting surface 4. A roundness R4 is provided on the boundary between the outer surface 84 and the hitting surface 4. The outer surface 84 constitutes a part of the sole surface of the head 2.

The roundness R3 improves molten metal flow in the casting of the face member fc1, and can reduce defective rate in the casting. The roundness R4 improves molten metal flow in the casting of the face member fc1, and can reduce defective rate in the casting.

As well shown in FIG. 10, the first flange FL1 has a toe-side end face T1 and a heel-side end face H1. The toe-side end face T1 is located on the heel side relative to the point RA (see FIG. 2). A toe-heel direction position of the heel-side end face H1 is the same as that of the point RB. As shown in FIG. 11, a heel-side end face EH1 of the face member fc1 includes the heel-side end face H1. The heel-side end face EH1 of the face member fc1 is a single plane as a whole. The end face EH1 is brought into contact with the heel boundary surface 22 of the body member bd1 (see FIG. 7). The end face EH1 is welded to the heel boundary surface 22.

The toe-side end face T1 of the first flange FL1 is brought into contact with the top-side end face 42 of the toe wall part 38 (see FIG. 6). The heel-side end face H1 of the first flange FL1 is brought into contact with the heel boundary surface 22.

The toe-side end face T1 of the first flange FL1 is welded to the top-side end face 42 of the toe wall part 38. The heel-side end face H1 of the first flange FL1 is welded to the heel boundary surface 22.

As well shown in FIG. 10, the second flange FL2 has a toe-side end face T2, and a heel-side end face H2. The toe-side end face T2 is located on the heel side relative to the point RD (see FIG. 2). The toe-heel direction position of the heel-side end face H2 is the same as that of the point RC. As shown in FIG. 11, the heel-side end face EH1 of the face member fc1 includes the heel-side end face H2.

The toe-side end face T2 of the second flange FL2 is brought into contact with the sole-side end face 44 (see FIG. 6) of the toe wall part 38 of the body member bd1. The heel-side end face H2 of the second flange FL2 is brought into contact with the heel boundary surface 22.

The toe-side end face T2 of the second flange FL2 is welded to the sole-side end face 44 of the toe wall part 38 of the body member bd1. The heel-side end face H2 of the second flange FL2 is welded to the heel boundary surface 22.

As shown in FIG. 8, the backend surface 70 of the first flange FL1 is brought into contact with the top receiving surface 34 of the top portion 24. This contact is surface-contact. The backend surface 70 is welded to the top receiving surface 34.

As shown in FIG. 8, the backend surface 80 of the second flange FL2 is brought into contact with the sole receiving surface 50 of the sole portion 28. This contact is surface-contact. The backend surface 80 is welded to the sole receiving surface 50.

As shown in FIG. 8, the head 2 has an undercut part UC. In the present application, the undercut part UC means a portion in which a gap in the face perpendicular direction between the face member fc1 and the body member bd1 is present. The undercut part UC expands a movable range of the flat plate portion PT. The undercut part UC facilitates the deformation of the flat plate portion PT at impact. The undercut part UC enhances rebound performance of the head 2.

The undercut part UC includes a top-side undercut UC1 located between the top portion 24 and the flat plate portion PT. The top-side undercut UC1 enhances rebound performance in the top side of the hitting surface 4.

The undercut part UC includes a sole-side undercut UC2 located between the sole portion 28 and the flat plate portion PT. The sole-side undercut UC2 enhances rebound performance in the sole side of the hitting surface 4.

As shown in FIG. 8, the inner surface 72 of the first flange FL1 is not brought into contact with the body member bd1. The inner surface 72 faces a space (a space inside the top-side undercut UC1). The outer surface 74 of the first flange FL1 is not brought into contact with the body member bd1, either. The outer surface 74 faces a space (outside space). For this reason, restraint on the first flange FL1 laid by the body member bd1 is suppressed. The first flange FL1 is apt to be deformed. The first flange FL1 facilitates deformation of the hitting surface 4 at impact. The first flange FL1 contributes to improvement in rebound performance.

As shown in FIG. 8, the inner surface 82 of the second flange FL2 is not brought into contact with the body member bd1. The inner surface 82 faces a space (a space inside the sole-side undercut UC2). The outer surface 84 of the second flange FL2 is not brought into contact with the body member bd1, either. The outer surface 84 faces a space (outside space). For this reason, restraint on the second flange FL2 laid by the body member bd1 is suppressed. The second flange FL2 is apt to be deformed. The second flange FL2 facilitates deformation of the hitting surface 4 at impact. The second flange FL2 contributes to improvement in rebound performance.

Except for a portion brought into contact with the toe receiving surface 40, the flat plate portion PT of the hitting surface 4 is not supported from behind. The most portion of the back surface 60 is not brought into contact with the body member bd1. This constitution facilitates deformation of the hitting surface 4 at impact. The flat plate portion PT which has the back surface 60 contributes to improvement in coefficient of restitution.

[Casting Deformation Suppressing Effect]

As described above, the face member fc1 is formed by casting. As compared with forging, casting makes the manufacture of the face member fc1 comparatively easy, even when the face member fc1 has a complex shape including the first flange FL1 and the second flange FL2.

However, it has been found that when a face member having a flange extending continuously from the top-side region, through the toe-side region, to the sole-side region is produced, deformation by casting (casting deformation) of the face member becomes large. It also has been found that the deformation by casting reduces the degree of flatness of the face. The low degree of flatness necessitates further time and effort of subsequent treatment for enhancing the degree of flatness. In addition, the low degree of flatness increases defective rate.

On the other hand, it has turned out that deformation by casting is suppressed in the face member fc1 of the present embodiment. In the face member fc1, the degree of flatness of the hitting surface 4 after casting is high. In the present application, this effect is also referred to as a casting deformation suppressing effect.

The reason why the casting deformation suppressing effect is obtained is supposed as follows. In a face member having a plate shape, even when the face member is subjected to casting, casting deformation such as shrinkage is restrictive. As compared with this, in a face member having a flange, casting deformation such as shrinkage is large because of the presence of the flange. It is considered that the casting deformation occurs because the flange is provided only one side surface (back surface) of the plate and thus the face member is un-uniformly shrunk.

In the flange extending from the top-side region through the toe-side region to the sole-side region, the flange is long and is curved with a large curvature. When the curvature is large, difference between a peripheral length of the inside of the flange and a peripheral length of the outside of the flange becomes large. It is considered that when the curvature is large, the influence of the shrinkage of the flange is increased to make the casting deformation larger.

On the other hand, in the face member fc1 of the present embodiment, the flange FL is split into two. That is, the flange FL is dividedly disposed in the top-side region and the sole-side region, and each of the flange FL1 and the flange FL2 is short. For this reason, the influence of the shrinkage of the flange FL is reduced and the casting deformation is suppressed.

Further, the contour line CL in the top-side region relatively resembles a straight line as compared with that of the toe-side region. Therefore, the first flange FL1 provided along the contour line CL in the top-side region is less curved (see FIG. 9). The casting deformation is suppressed by the less curved first flange FL1.

The same holds true for the second flange FL2. The contour line CL in the sole-side region is relatively resembles a straight line as compared with that of the toe-side region (see FIG. 9). Therefore, the second flange FL2 provided along the contour line CL in the sole-side region is less curved. The casting deformation is suppressed by the less curved second flange FL2.

In addition, rebound performance is enhanced in a wide scope ranging from the top side to the sole side by the first flange FL1 and the second flange FL2. Even if a hit point is close to the sole, a high rebound performance can be obtained. Even if a hit point is close to the top, a high rebound performance can be obtained.

In light of suppressing the casting deformation, a curvature radius in the extending direction of the flange FL is preferably large. In this respect, a curvature radius of an inner edge line 70*a* (see FIG. 10) on the backend surface 70 of the first flange FL1 is preferably equal to or greater than 100 mm, more preferably equal to or greater than 200 mm, and still more preferably equal to or greater than 300 mm. The curvature radius maybe infinity. That is, the inner edge line 70*a* may be a straight line. The curvature radius is measured in the plan view (back view in FIG. 10) of the face member fc1 as view from the back side.

In light of suppressing the casting deformation, a curvature radius in the extending direction of the flange FL is preferably large. In this respect, a curvature radius of an inner edge line 80*a* (see FIG. 10) in the backend surface 80 of the second flange FL2 is preferably equal to or greater than 100 mm, more preferably equal to or greater than 200 mm, and still more preferably equal to or greater than 300 mm. The curvature radius maybe infinity. That is, the inner edge line 80*a* may be a straight line. The curvature radius is measured in the plan view (back view in FIG. 10) of the face member fc1 as viewed from the back side.

A double-pointed arrow H1 in FIG. 13 shows a height of the first flange FL1. The height H1 is measured along the face perpendicular direction. The height H1 is a height from the back surface 60. A double-pointed arrow H2 in FIG. 13 shows a height of the second flange FL2. The height H2 is measured along the face perpendicular direction. The height H2 is a height from the back surface 60.

The height H2 of the second flange FL2 is greater than the height H1 of the first flange FL1. A flange having a large height is apt to be deformed at impact. This constitution further enhances rebound performance when the hit point is close to the sole. In other words, rebound performance in hitting at a lower hit point is enhanced.

A ball which is not teed up is often hit by an iron type golf club head. That is, a ball which is put directly on a lawn is often hit by the iron type golf club. For this reason, hitting by the iron type golf club often results in hitting at a lower hit point. The constitution in which the height H2 is greater than the height H1 is suitable for the iron type golf club head, because the constitution has an excellent rebound performance in hitting at a lower hit point.

In the present embodiment, the height H1 is constant. The height H1 may vary with the toe-heel direction position. In the present embodiment, the height H2 is constant. The height H2 may vary with the toe-heel direction position. It is preferable that the height H2 is larger than the height H1 at any toe-heel direction position.

In light of rebound performance, the height H1 is preferably equal to or greater than 1.0 mm, more preferably equal to or greater than 1.5 mm, and still more preferably equal to or greater than 1.75 mm. In view of the dimension of a top blade, the height H1 is preferably equal to or less than 5.0 mm, and more preferably equal to or less than 4.0 mm.

In light of rebound performance, the height H2 is preferably equal to or greater than 2.0 mm, more preferably equal to or greater than 2.5 mm, and still more preferably equal to or greater than 3.0 mm. In light of strength, the height H2 is preferably equal to or less than 7.0 mm, and more preferably equal to or less than 6.0 mm.

A double-pointed arrow T1 in FIG. 13 shows a thickness of the first flange FL1. The thickness T1 is measured along the up-down direction. A double-pointed arrow T2 in FIG. 13 shows a thickness of the second flange FL2. The thickness T2 is measured along the up-down direction.

In the present embodiment, the thickness T2 of the second flange FL2 is smaller than the thickness T1 of the first flange FL1. A flange having a small thickness is apt to be deformed at impact. This constitution further enhances rebound performance in hitting at a lower hit point. The constitution is suitable for the iron type golf club head, because the constitution has an excellent rebound performance in hitting at a lower hit point.

As shown in FIG. 13, the thickness T2 is varied depending on the position in the face perpendicular direction. The thickness T2 shown in FIG. 13 is the thickness T2 at the backend surface of the second flange FL2. Thus, the thickness T2 may be varied depending on the position in the face perpendicular direction. Similarly, the thickness T1 may be varied depending on the position in the face perpendicular direction.

When a case where the thickness T1 and/or the thickness T2 is varied depending on the position in the face perpendicular direction is also taken into consideration, in light of rebound performance in hitting at a lower hit point, the following constitution is preferable.

(a) The maximum value of the thickness T2 is smaller than the minimum value of the thickness T1 at any toe-heel direction position.

The thickness T2 of the second flange FL2 may be greater than the thickness T1 of the first flange FL1. This constitution makes the center of gravity of the head lower to improve hit feeling in hitting at a low hit point and to achieve a high trajectory of the hit ball.

When a case where the thickness T1 and/or the thickness T2 is varied depending on the position in the face perpendicular direction is also taken into consideration, in light of lowering the center of gravity of the head, the following constitution is preferable.

(b) The minimum value of the thickness T2 is greater than the maximum value of the thickness T1 at any toe-heel direction position.

In light of strength, the thickness T1 is preferably equal to or greater than 0.5 mm, more preferably equal to or greater than 0.6 mm, and still more preferably equal to or greater than 0.7 mm. In light of rebound performance, the thickness T1 is preferably equal to or less than 2.0 mm, more preferably equal to or less than 1.9 mm, and still more preferably equal to or less than 1.8 mm.

In light of strength, the thickness T2 is preferably equal to or greater than 0.5 mm, more preferably equal to or greater than 0.6 mm, and still more preferably equal to or greater than 0.7 mm. In light of rebound performance, the thickness T2 is preferably equal to or less than 2.0 mm, more preferably equal to or less than 1.9 mm, and still more preferably equal to or less than 1.8 mm.

In light of lowering the center of gravity of the head, the second flange FL2 has a volume greater than that of the first flange FL1. Note that, in the determination of the volume of the first flange FL1, a portion located on the back side with respect to a plane made by extending the back surface 60 is considered as the first flange FL1. Similarly, in the determination of the volume of the second flange FL2, a portion located on the back side with respect to a plane made by extending the back surface 60 is considered as the second flange FL2.

A double-pointed arrow L1 in FIG. 10 shows a length of the first flange FL1. The length L1 is measured along the toe-heel direction. A double-pointed arrow L2 in FIG. 10 is a length of the second flange FL2. The length L2 is measured along the toe-heel direction. A double-pointed arrow L3 in FIG. 9 shows a length of the longest score line gv1. The length L3 is measured along the toe-heel direction.

In light of rebound performance, a ratio (L1/L3) is preferably equal to or greater than 0.7, more preferably equal to or greater than 0.8, and still more preferably equal to or greater than 0.9. In view of the dimension of the top-side region, the ratio (L1/L3) is preferably equal to or less than 1.2, more preferably equal to or less than 1.15, and still more preferably equal to or less than 1.1.

In light of rebound performance, a ratio (L2/L3) is preferably equal to or greater than 0.7, more preferably equal to or greater than 0.8, and still more preferably equal to or greater than 0.9. In light of the dimension of the top-side region, the ratio (L2/L3) is preferably equal to or less than 1.2, more preferably equal to or less than 1.15, and still more preferably equal to or less than 1.1.

Figure 14:
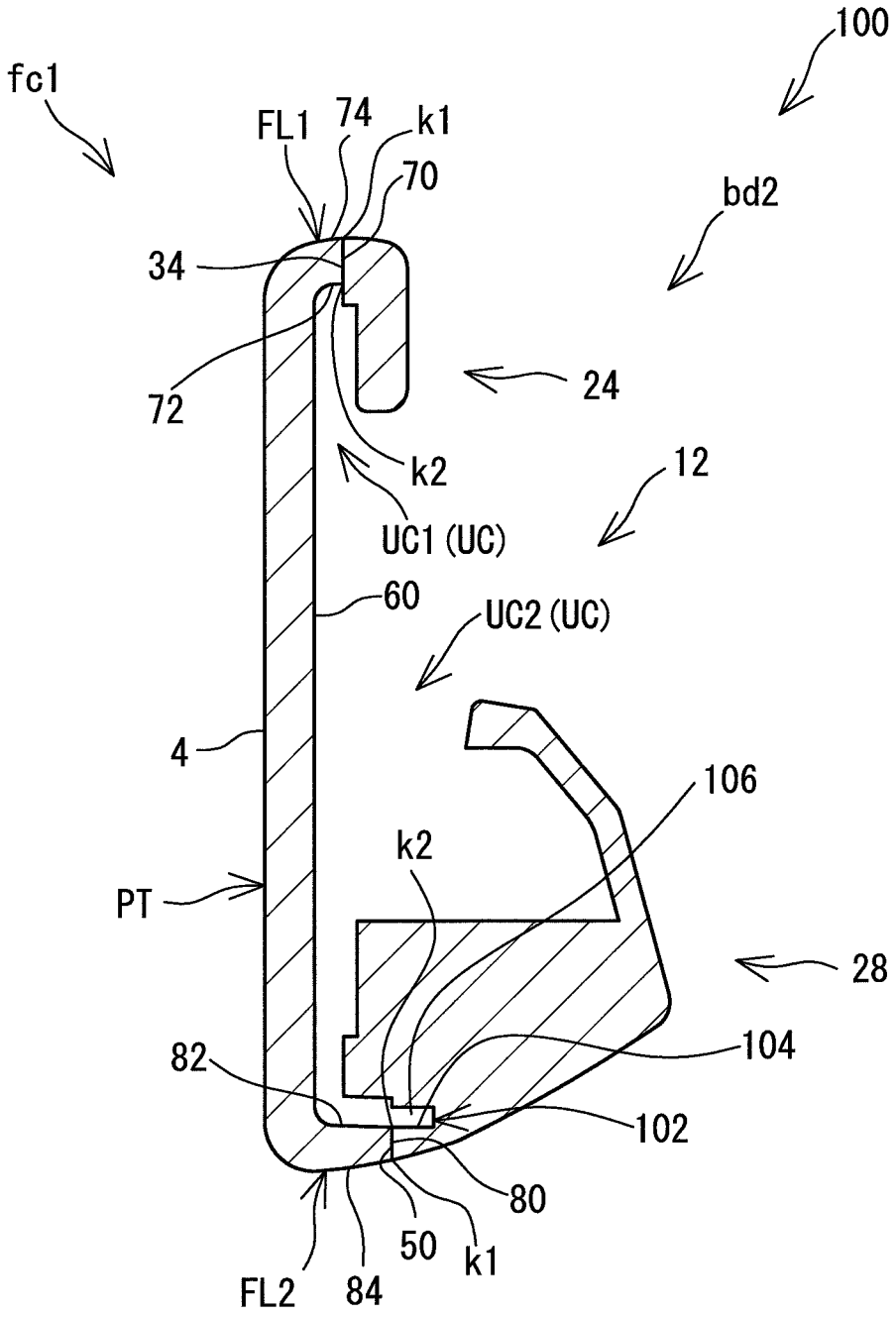
FIG. 14 is a sectional view of a golf club head according to a second embodiment.

FIG. 14 is a sectional view of a golf club head 100 according to a second embodiment. The head 100 includes a face member fc1 and a body member bd2. The head 100 has an outer boundary k1 which is a boundary between the face member fc1 and the body member bd2, and is located outside the head 100. The head 100 has an inner boundary k2 which is a boundary between the face member fc1 and the body member bd2, and is located inside the head 100. The body member bd2 has a recess part 102 which is adjacent to the inner boundary k2. Except for the presence of the recess part 102, the head 100 is the same as the head 2.

The head 100 (body member bd2) has an inner boundary back surface 104 which is extended backward from the inner boundary k2. The inner boundary k2 is a boundary between the inner surface 82 and the inner boundary back surface 104. The head 100 (body member bd2) has a back space 106 which is adjacent to the inner boundary back surface 104. In the present embodiment, the inner boundary back surface 104 and the back space 106 are formed by the recess part 102 provided on the sole receiving surface 50.

When the sole receiving surface 50 and the backend surface 80 are welded to each other, weld bead may accumulate in the vicinity of the inner boundary k2. If the bead accumulates inside the flange FL, the rigidity of the flange FL becomes high. If the rigidity of flange FL becomes high, rebound performance deteriorates.

A part of the bead flows to backward of the inner boundary k2 by providing the inner boundary back surface 104. For this reason, the amount of the bead accumulating inside the flange FL decreases. As a result, the increase in the rigidity of the flange FL is suppressed and the deterioration of rebound performance is suppressed.

The face member fc1 is made of a metal which can be subjected to casting. Examples of the metal include pure titanium, a titanium alloy, stainless steel, maraging steel, an aluminum alloy, a magnesium alloy, and a tungsten-nickel alloy. In light of easiness of casting and strength, a titanium alloy and stainless steel are preferable, and stainless steel is more preferable.

In light of weldability with the face member fc1, a material of the body member bd1 is preferably the same kind of material as that of the face member fc1, and is more preferably the same material as that of the face member fc1. Note that the same kind of material means a material having a same principal component. The principal component means a component having a weight ratio of 50% or more.

As explained above, in the present embodiments, the flange FL is secured in both the top-side region and the sole-side region to enhance rebound performance, and a casting method is adopted to enhance productivity of the face member fc1 having the flange FL. Furthermore, the disposal of the flange FL is optimized to suppress the casting deformation and to enhance the degree of flatness of the hitting surface 4.

The present disclosure can be preferably applied to an iron type head.

The above description is merely illustrative example, and various modifications can be made.

What is claimed is:

1. A golf club head comprising:

a face member formed by casting; and a body member having an opening on a hitting surface side, wherein:

the opening of the body member is covered by the face member;

the face member includes a flat plate portion forming the hitting surface, and a flange extending backward from a peripheral edge of the flat plate portion;

the flange includes a first flange located in a top-side region, and a second flange located in a sole-side region;

the flange is not provided in a toe-side region and a heel-side region, the flange is joined to the body member; and a height H2 of the second flange is greater than a height H1 of the first flange.

2. The golf club head according to claim 1, wherein a thickness T2 of the second flange is greater than a thickness T1 of the first flange.

3. The golf club head according to claim 2, wherein the thickness T1 is equal to or greater than 0.5 mm and equal to or less than 2.0 mm.

4. The golf club head according to claim 2, wherein the thickness T2 is equal to or greater than 0.5 mm and equal to or less than 2.0 mm.

5. The golf club head according to claim 1, wherein the height H1 is equal to or greater than 1.0 mm and equal to or less than 5.0 mm.

6. The golf club head according to claim 1, wherein the height H2 is equal to or greater than 2.0 mm and equal to or less than 7.0 mm.

7. The golf club head according to claim 1, wherein a volume of the second flange is greater than a volume of the first flange.

8. A golf club head comprising:

a face member formed by casting; and a body member having an opening on a hitting surface side, wherein:

the opening of the body member is covered by the face member;

the face member includes a flat plate portion forming the hitting surface, and a flange extending backward from a peripheral edge of the flat plate portion;

the flange includes a first flange located in a top-side region, and a second flange located in a sole-side region;

the flange is not provided in a toe-side region and a heel-side region, the flange is joined to the body member; and a thickness T2 of the second flange is smaller than a thickness T1 of the first flange.

9. The golf club head according to claim 8, wherein the thickness T1 is equal to or greater than 0.5 mm and equal to or less than 2.0 mm.

10. The golf club head according to claim 4, wherein the thickness T2 is equal to or greater than 0.5 mm and equal to or less than 2.0 mm.

11. A golf club head comprising:

a face member formed by casting; and a body member having an opening on a hitting surface side, wherein:

the opening of the body member is covered by the face member;

the face member includes a flat plate portion forming the hitting surface, and a flange extending backward from a peripheral edge of the flat plate portion;

the flange includes a first flange located in a top-side region, and a second flange located in a sole-side region;

the flange is not provided in a toe-side region and a heel-side region, the flange is joined to the body member, the face member has a plurality of score lines, the score lines include a longest score line, and if a length of the first flange is represented by L1, and a length of the longest score line is represented by L3, then L1/L3 is equal to or greater than 0.7 and equal to or less than 1.2.

12. A golf club head wherein comprising:

a face member formed by casting; and a body member having an opening on a hitting surface side, wherein:

the opening of the body member is covered by the face member;

the face member includes a flat plate portion forming the hitting surface, and a flange extending backward from a peripheral edge of the flat plate portion;

the flange includes a first flange located in a top-side region, and a second flange located in a sole-side region;

the flange is not provided in a toe-side region and a heel-side region, the flange is joined to the body member, the face member has a plurality of score lines, the score lines include a longest score line, and if a length of the second flange is represented by L2, and a length of the longest score line is represented by L3, then L2/L3 is equal to or greater than 0.7 and equal to or less than 1.2.

* * * * *